US007625329B2

(12) United States Patent
Koehler et al.

(10) Patent No.: US 7,625,329 B2
(45) Date of Patent: Dec. 1, 2009

(54) CARTON BLANK TRANSPORT

(75) Inventors: Philip A. Koehler, River Falls, WI (US); Jonathan K. Otto, Amery, WI (US)

(73) Assignee: Doboy, Inc., New Richmond, WI (US)

( * ) Notice: Subject to any disclaimer, the term of this patent is extended or adjusted under 35 U.S.C. 154(b) by 503 days.

(21) Appl. No.: 10/979,528

(22) Filed: Nov. 2, 2004

(65) Prior Publication Data

US 2006/0119028 A1 Jun. 8, 2006

(51) Int. Cl.
*B05D 5/10* (2006.01)

(52) U.S. Cl. ..... 493/331; 493/128; 493/131; 493/150

(58) Field of Classification Search ..... 493/331, 493/81, 124, 125, 128, 131, 150, 917; 53/383.1, 53/206, 269, 460
See application file for complete search history.

(56) References Cited

U.S. PATENT DOCUMENTS

| | | | | | |
|---|---|---|---|---|---|
| 31,588 | A * | 3/1861 | Chambers | 493/331 |
| 1,843,964 | A * | 2/1932 | Wolff | 493/31 |
| 2,655,843 | A * | 10/1953 | Baker et al. | 493/124 |
| 3,411,969 | A * | 11/1968 | Ragan et al. | 156/227 |
| 3,456,816 | A * | 7/1969 | Galloway | 414/798.9 |
| 3,854,385 | A | 12/1974 | Wallin | |
| 4,194,442 | A * | 3/1980 | Martelli | 493/316 |
| 4,871,348 | A * | 10/1989 | Konaka | 493/315 |
| 5,054,761 | A * | 10/1991 | Dietrich et al. | 271/95 |
| 5,715,657 | A * | 2/1998 | Mondani et al. | 53/457 |
| 6,050,054 | A * | 4/2000 | Van Lierde et al. | 53/284.3 |
| 6,474,635 | B2 * | 11/2002 | Ruf et al. | 271/12 |
| 6,620,085 | B2 * | 9/2003 | Gambetti | 493/71 |

FOREIGN PATENT DOCUMENTS

| | | |
|---|---|---|
| CH | 400 749 | 10/1965 |
| DE | 44 19 639 | 12/1994 |
| DE | 199 14 578 | 10/2000 |

* cited by examiner

*Primary Examiner*—Sameh H. Tawfik
(74) *Attorney, Agent, or Firm*—Nikolai & Mersereau, P.A.; C. G. Mersereau

(57) ABSTRACT

A transport mechanism is disclosed for handling and manipulating flat objects such as carton blanks through an intermediate processing step such as the application of adhesive to end tabs prior to die and plunger carton formation. Specifically, the invention enables a blank to be picked from a magazine, run past an adhesive application system at a fixed, constant distance and speed, and deposited in place for a carton forming step using a single mechanism.

20 Claims, 5 Drawing Sheets

CARTON BLANK TRANSPORT

BACKGROUND OF THE INVENTION

1. Field of the Invention

The present invention relates generally to packaging machinery and, more particularly, to a transport mechanism for handling and manipulating flat objects such as carton blanks through an intermediate processing step such as the application of adhesive to end tabs prior to die and plunger carton formation. Specifically, the invention enables a blank to be picked from a magazine, run past an adhesive application system at a fixed, constant distance and speed, and deposited in place for a carton forming step using a single mechanism.

2. Related Art

Packaging container cartons are typically folded and formed from flat carton blanks that are forced into a die using a plunger. Prior to forming, adhesive is applied to the tabs of the flat carton blanks where they are desired to adhere in the folded, formed state. This has previously been accomplished using a plurality of consecutive mechanisms. The first mechanism includes a device for vacuum-picking carton blanks off a stack or magazine and depositing them in front of the head of a shuttle system. The shuttle system is then used to move the blanks past one or more glue heads which is activated using an optical sensor which contains a built-in programmable timing system which includes a timed delay and a timed pattern for applying glue to the carton blank as it goes past. The shuttle system then deposits the blank in position for formation in a die using a conventional die and plunger system and retracts to receive the next blank. While such a combined system is satisfactory, it is quite expensive and includes an open, exposed mechanism. There has long been a need to replace such a multi-mechanism system with a single mechanism system with the ability to pick a carton blank from a source of supply, run it past an adhesive applicator at the desired distance and speed and deposit it in place for carton formation.

SUMMARY OF THE INVENTION

By means of the present invention, there is provided a reciprocating transport system for processing flat objects fed from a magazine stack, or other type pick and place supply. The system includes a pivoting transport carriage that has the ability to acquire and manipulate flat objects of interest past a processing device at a speed and distance from that processing device as designed by the drive system. The transport system of the invention thereafter releases the objects at a location and disposition according to a next processing step. The transport system of the invention is characterized by the coordination of a powered rotating cam and a pair of spaced flat plate cams. A drive motor powers the rotary cam which, through a linkage system, actuates a crank lever which provides reciprocating motion and speed control of the transport carriage. The transport carriage actuated by the rotary cam is driven through the pair of flat cams positioned one per side of the machine. The flat cam profile provides the means of controlling the position of the flat object from the pick location at the magazine supply or other supply through a work zone and past a processing device such as a glue application system and finally releasing the object in position for the next process step. The rotary cam is designed to operate at a constant speed and the cam and lever combination enables not only precise pick and release locations but precise control of speed and distance as the flat object traverses a processing zone.

The embodiment of the detailed description is directed to a reciprocating or cycling carton blank transport system in which the flat objects are carton blanks and in which the carton blank transport system is a device integral to a carton forming machine. The system is designed to operate in conjunction with a carton blank supply magazine, adhesive application system, which may apply hot melt or other glues to designated portions of a carton blank such as end tabs, and an ensuing carton forming operation which uses a plunger and carton forming die system in a manner well known to those in the art to produce a three-dimensional carton. In this embodiment, the rotating cam, crank lever system and flat plate cams cooperate in a manner such that the pivotally mounted carton blank transport carriage actuated by the rotary cam with followers is driven along the profile of the flat plate cams during a processing part of the operation. The carton blank picked up from the pick location at the magazine stack supply proceeds through the adhesive application zone to accurate placement at a carton forming die set.

The blank processing part of the cycle is associated with the rotary cam proceeding through approximately one-half revolution. In the second half of each revolution, the carton blank transport carriage is caused to return along the profile of the flat plate cams causing the carriage to retrace and return to the pick location to retrieve another blank for the next cycle.

An important aspect of the invention pertains to the combination of the pivotal mount of the blank transport carriage, peripheral profile shape of the rotary drive cam, construction of the crank lever and linkage system and the profile of the flat plate cams. These all combine, not only to precisely position the transport carriage to pick up and discharge a flat carton blank or other flat object with precision, but also, in a preferred embodiment, to provide a process or adhesive application zone in which the carton blank or other flat plate object passes glue guns or other devices at a constant angle, constant distance and constant speed. In one embodiment, this zone is about 330 mm in length. It will be appreciated that the cam and lever combination can be designed to modify the profile of the transport process if desired.

BRIEF DESCRIPTION OF THE DRAWINGS

In the drawings, wherein like numerals depict like parts throughout the same.

DETAILED DESCRIPTION

The following detailed description pertains to a carton blank transport system for manipulating carton blanks from a stock supply through adhesive application and placement at a carton forming die. The apparatus is an integral part of carton forming machinery and the steps followed are part of the overall process of carton formation from blanks. It will be appreciated, however, that the concept can be used in other situations in which flat objects need to be acquired, manipulated past a processing device at a desired distance and speed profile and placed in position for the next step using a single mechanism.

Figure 1:
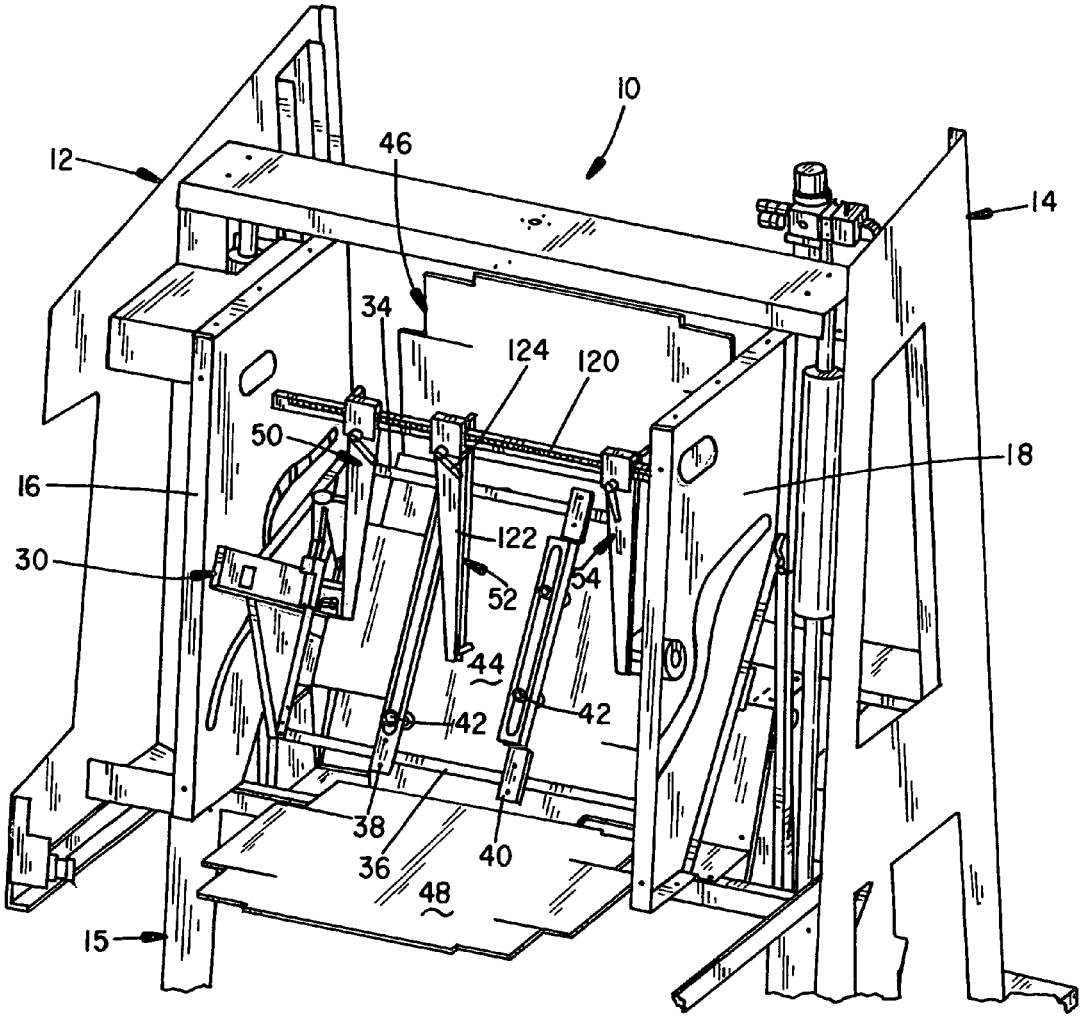
FIG. 1 is a partial front perspective view of a carton blank transport system in accordance with the invention.
Figure 2:
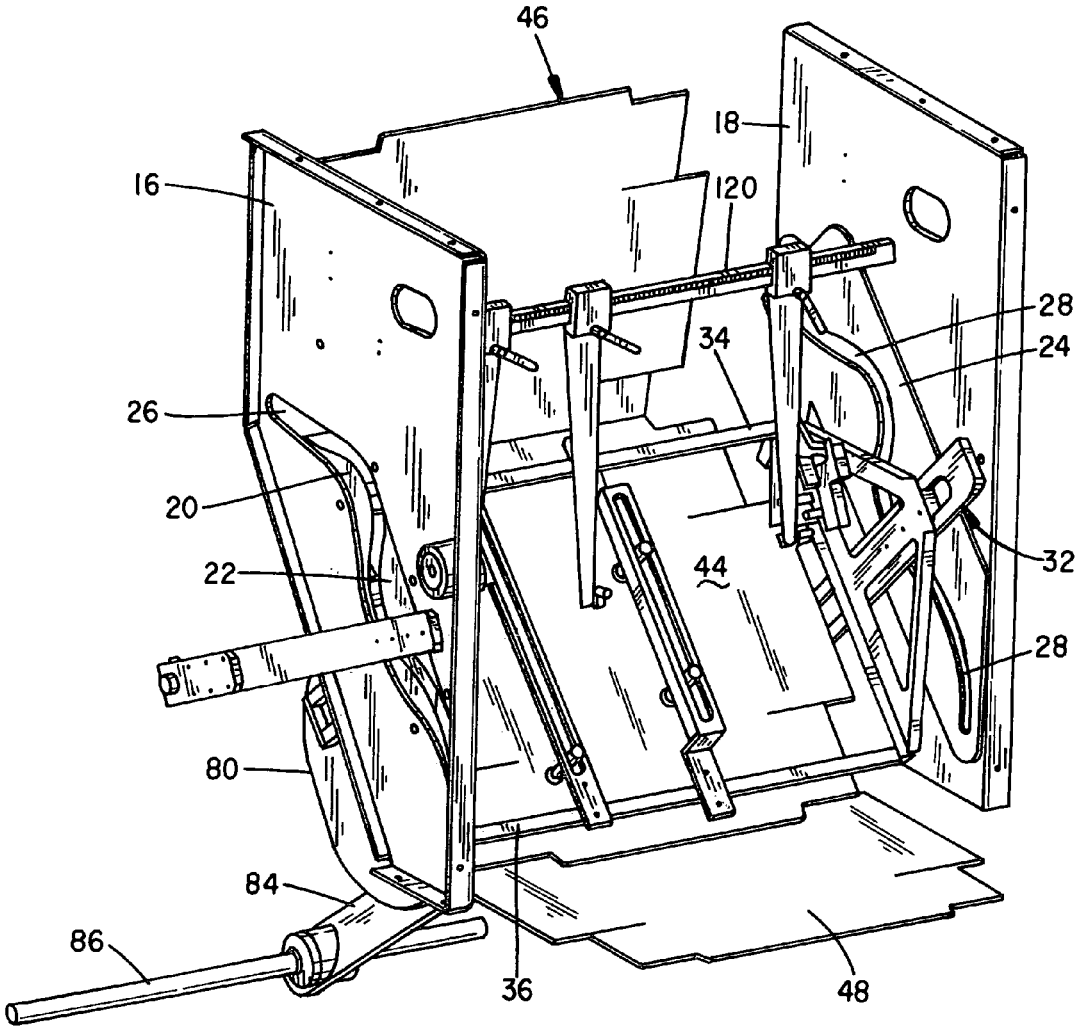
FIG. 2 is a view similar to that of FIG. 1 taken at a slightly different angle and with parts removed to clarify details.
Figure 3B:
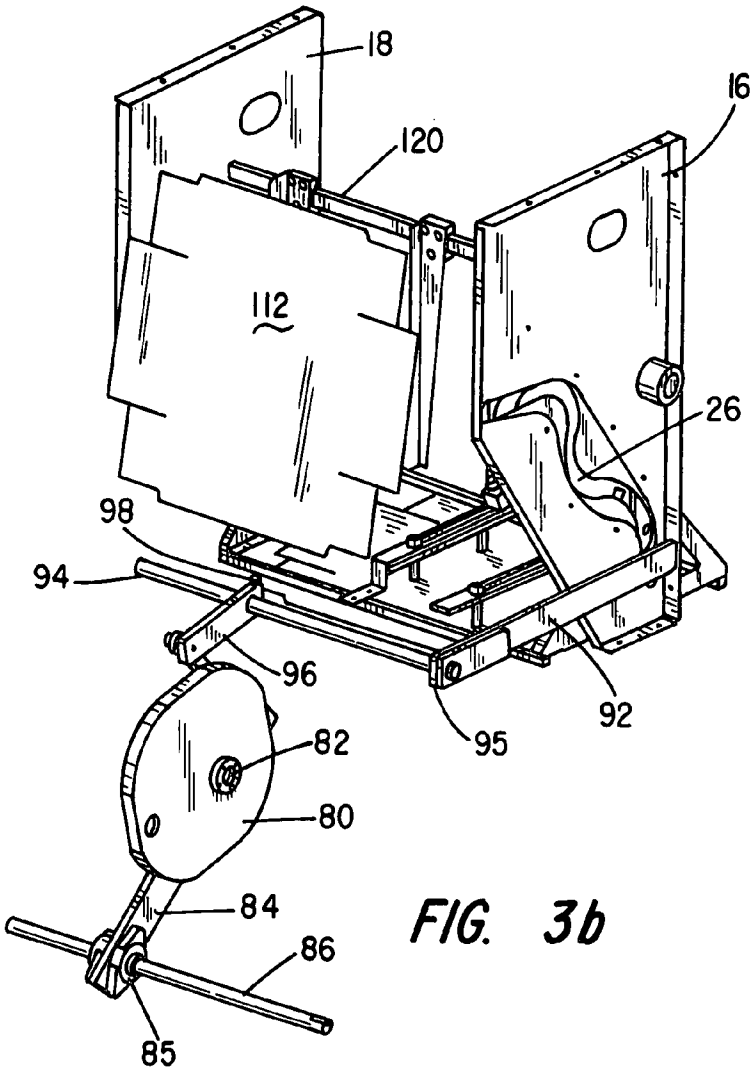
FIGS. 3*a* and 3*b* are rear perspective views illustrating certain details of a drive system in accordance with the invention with parts removed and showing the system in two positions.
Figure 3A:
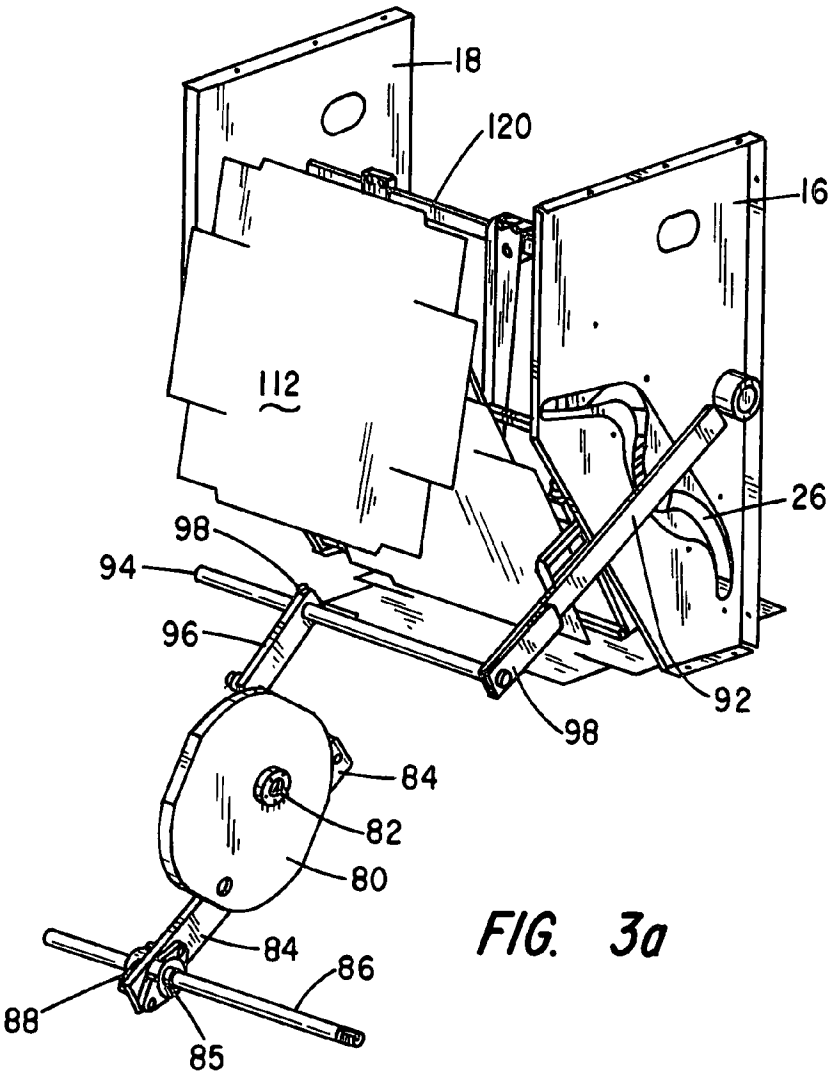

FIGS. 1 and 2 depict partial front perspective views of a carton blank transport system in accordance with the invention. The system, shown generally at 10, is flanked by a pair of side support frames 12 and 14. A partial lower support structure is illustrated at 15. The structure of the transport system of the invention itself includes a pair of opposed spaced side panels 16 and 18 spanned by cross members (not shown). The side panels 16 and 18 are each provided with a shaped opening (as at 20 in FIG. 2) which accommodates the profile of a flat plate cam as at 22 and 24. The cams have identically shaped profiles 26 and 28. The system includes a flat object transport carriage which itself includes a pair of spaced side structures 30 and 32 connected by spaced cross struts 34 and 36. The carriage includes a pair of flat object pick up and retaining devices as at 38 and 40 connected between strut members 34 and 36, each of which carries a plurality of suction cups as at 42. A retained carton blank is shown at 44 and the supply of blanks as it might appear in a magazine is depicted at 46. A blank ready for die forming is shown at 48.

The transport system cooperates with one or more integral carton blank or flat object processing devices. A plurality of spaced adhesive application devices are illustrated generally at 50, 52 and 54. These will be explained in further detail below in conjunction with other figures.

The carriage side structures are of identical opposed construction such that only one need be described in detail, the other being identical but opposite hand. These are best shown in the progressive schematic drawings of FIGS. 4*a*-4*c*. Each carriage side structure 30, 32 includes a pivot arm member 60 having an elongated central slot 61 and one end connected to pivot about a fixed shaft member as at 62. Each side structure includes an isosceles triangular shaped structure having a side 64 spanning the spaced cross struts 34 and 36, the two side structures thereby forming a carriage frame with the spaced cross struts. Each triangle further includes a central strut 66 which carries a rider 68 which, in turn, rides in the slot 61 of pivot arm 60. Each rider 68 also supports a cam follower attached at 70 which rides in the corresponding flat plate cam profile opening as at 26.

The drive mechanism which operates the reciprocating transport mechanism of the invention is best illustrated in the progressive schematic views of FIGS. 3*a*-3*b* and 4*a*-4*c*. The drive system includes a shaped eccentric rotary cam member 80 mounted to rotate on a driven fixed shaft at 82. The shaft 82 is driven by a conventional constant speed electric motor (not shown) in a well known manner. The rotary cam 80 is addressed by a lever arm 84 pivotally mounted at 85 to turn on a fixed shaft 86. A spring system at 88 attached to lever arm 84 urges an associated cam follower against the eccentric profile of rotary cam 80. A crank lever 92 is fixed to and pivots with a journaled fixed-position shaft 94 at 95 by a compression fitting connection and a link 96 is also fixed as by a compression fitting connection 98 to turn pivot shaft 94. A further link 100 is pivotally connected at 102 and 104 between link 96 and lever arm 84.

Figure 4B:
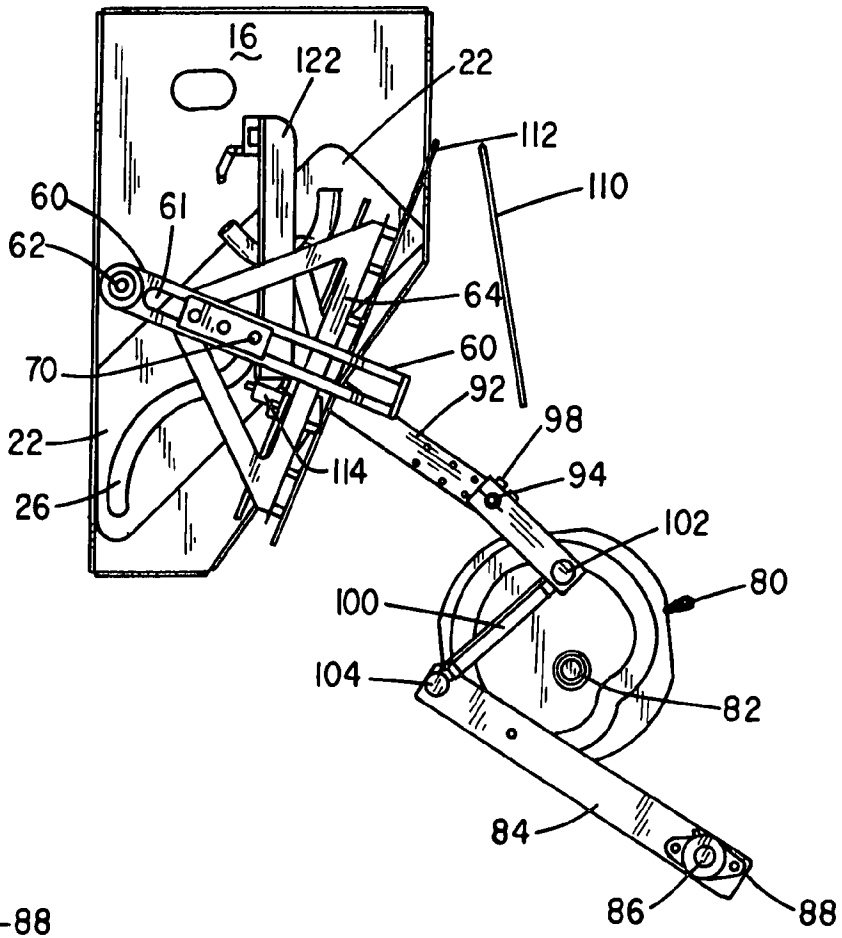
FIGS. 4*a*-4*c* are schematic representations of one side and the drive mechanism illustrating the operation of the carton blank transport system.
Figure 4A:
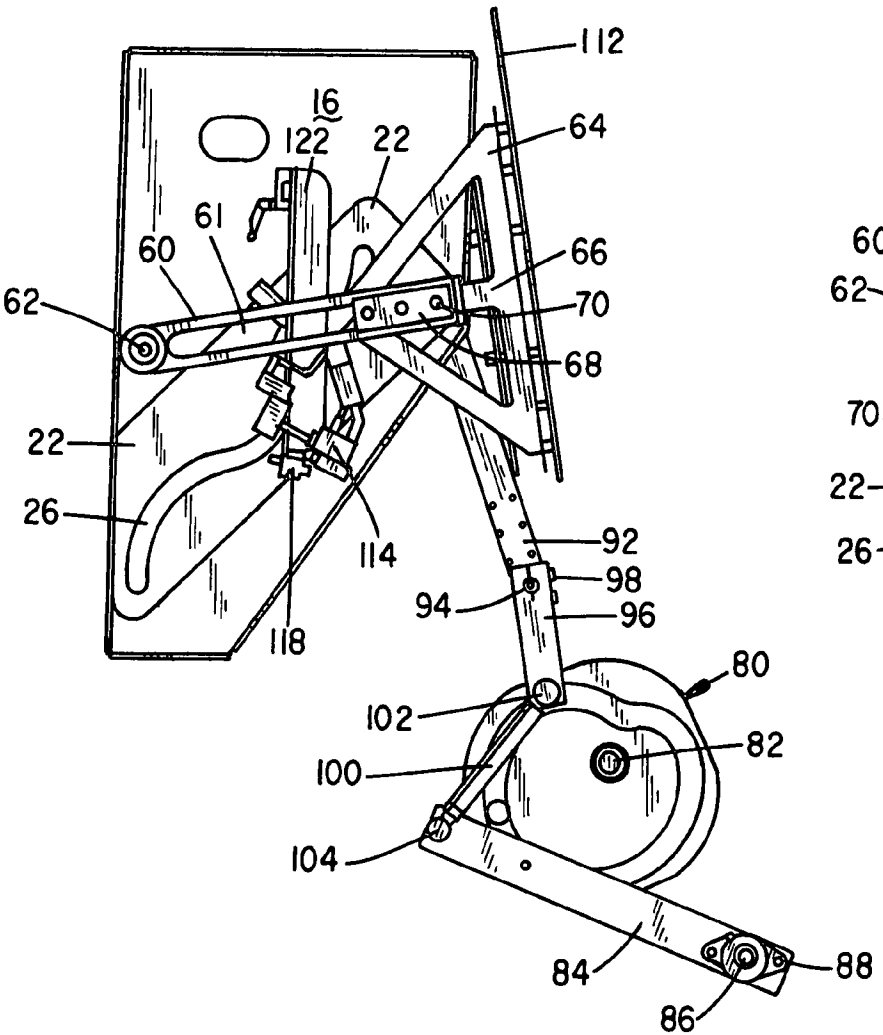
Figure 4C:
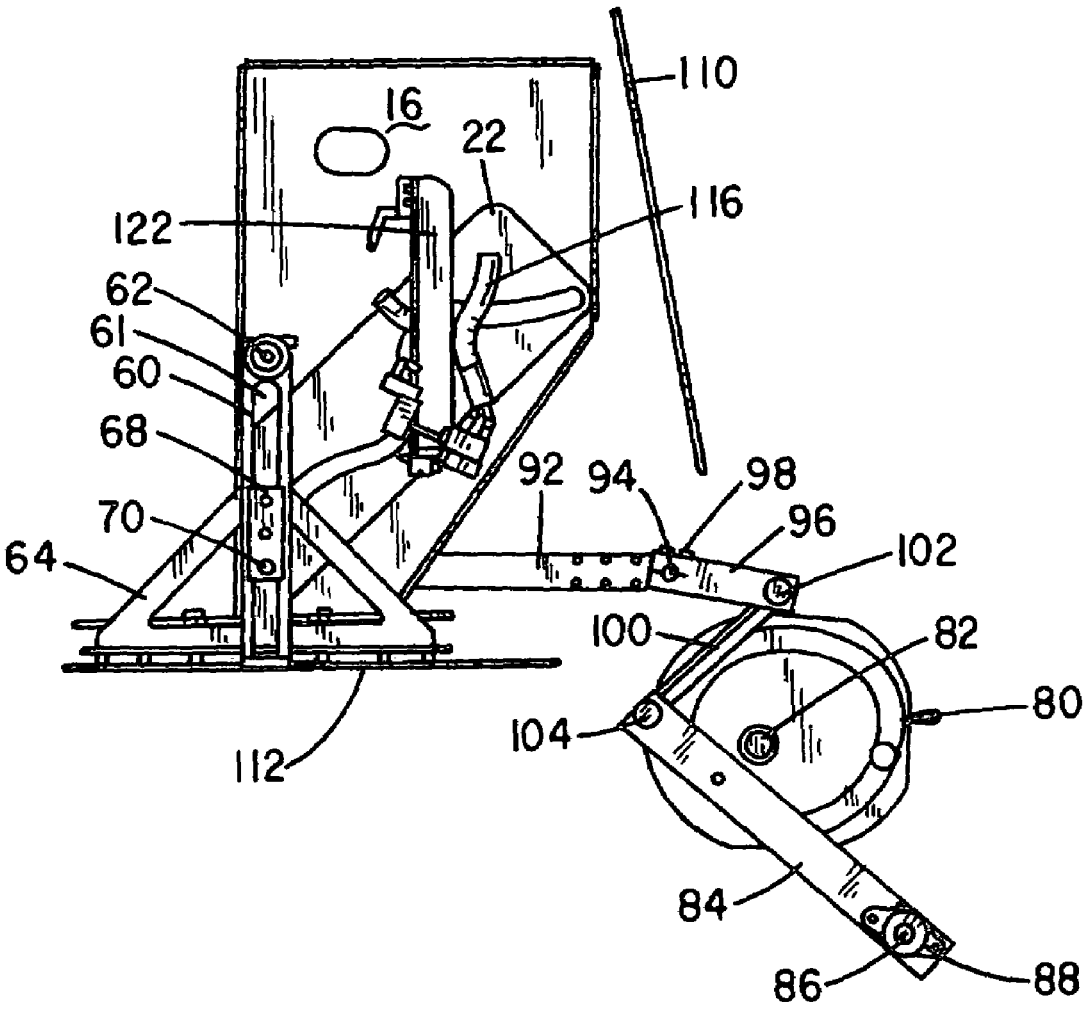

The FIGS. 4*a*-4*c* further include an indication of a supply magazine posture and location at 110 and illustrate the progression of a blank at 112. In addition, an adhesive application device is illustrated in greater detail in the FIGS. 4*a*-4*c* and includes a glue gun 114 supplied with hot melt glue or other adhesive through a line 116 and an optical sensing device is shown at 118. As seen in FIGS. 1 and 2, the adhesive application devices are supported from a support member 120 spanning between side walls 16 and 18 using hangers as at 122 which can be manually adjusted along the member 120 and tightened using handles at 124 to fix the glue head in place and this enables precise positioning of the adhesive to be administered relative to the blank of interest. This, of course, will vary according to the carton blank to be handled. A plurality of adhesive application devices can be positioned for each run. Thus, the application can be set for use with a plurality of different stock blanks and fixed in place as desired for each run.

The optical sensor 118, integral timing device and known speed of the system enable an application pattern to be programmed for each type of carton blank to be processed. When the edge of a carton is encountered by the optical sensing device, the timer then times out a delay and thereafter controls application of adhesive according to a further timed pattern which corresponds to the blank size, style and speed of the system. Because the reciprocating transport system of the invention enables the carton blank to pass the adhesive application devices at a constant speed and distance, this assures uniform application of adhesive in the proper places on the blank prior to carton formation.

In operation, the magazine or other source of supply of a stack of blanks is adjusted for the size of the blank in relation to the transport carriage. It should be noted that the center line of the carton blank is the center line of the base of the carton and this should be aligned with the center line of the arm member 60 when the transport carriage is in the fully retracted position ready to acquire or pick a blank. The system can be provided with an adjustable scale to adjust the location of the center line for each size blank being run. One such system (not shown) uses a hand crank and gear box, which can be adjusted and then locked in place for a particular run.

With the object transport carriage in the fully retracted position, suction cups on the carriage are then utilized to grab a blank from the magazine with the rotary cam activated and rotating clockwise to operate the system. Continued rotation of the rotary cam causes the carriage system to follow the profile of the flat plate cam openings at a speed as determined by the profile of the rotary cam. The combination of the levers and cam profiles is determined such that an acquired carton blank passes beneath the glue guns at a given distance and speed providing a constant velocity, constant distance work zone which, in one embodiment, is about 330 mm in length. This provides a constant distance and constant timing between the glue guns and the carton blank so that a uniform layer of adhesive may be applied. Control is achieved by using the optical sensor 118 to sense the passage of the edge of a carton blank which initiates the timer which coordinates the spraying of glue from the gun with the particular blank size and shape. This portion of the cycle is illustrated in FIG. 4*b* where the carriage is near the half-way point of the flat cam profiles.

The rotary cam continues to rotate causing the carriage to continue along the profile of the spaced flat plate cams to the position shown in FIG. 4*c* where the blank transport carriage is shown in a vertical position with the carton blank in a totally horizontal position to be discharged aligned in a precise position over a forming head die. Note that in the operation of the rotary cam system, the link 96 is caused to rotate the shaft 94 which, in turn, operates and pivots the lever 92 which, in turn, controls the progression of the blank transport carriage. It can also be seen from the drawings 4*a*-4*c* that, in going from the blank acquisition position in FIG. 4*a* to the discharge position in FIG. 4*c*, the rotary cam has rotated approximately 180°. At this point, the suction is released so the processed carton blank is released by the carriage which then is caused to retrace the pattern along the spaced flat plate cams as the rotary cam continues to rotate through the second 180° of a revolution. At this point, the transport mechanism is returned to the magazine supply and is ready to repeat the blank delivery cycle.

In one machine, the cycle time was about 1.7 seconds or about 35 cycles per minute for an adhesive-applying operation. Other operations may employ different cam profiles and achieve different cycle rates. Of course, such other operations may have no need to transport the carton blank at constant speed and position.

Of course, between delivery of glue-applied carton blanks to the forming die location, the forming die is operated to shape the carton which is then discharged and moved on in the process.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A flat object transport system comprising:

(a) A fixed position processing device for an application treatment of a moving flat object from said fixed position during a treating operation of the device wherein the fixed position is selectively adjustable between operations to accommodate different flat objects but in which the flat object being treated moves and the processing device remains still during said treating operation;

(b) A flat object transport carriage for carrying a flat object to be processed past said fixed position processing device; and (c) a reciprocating transport mechanism having a position and velocity control system further comprising:

1) a rotary eccentric drive cam for driving said reciprocating transport mechanism;

2) a crank lever connected between said rotary eccentric drive cam and said transport carriage; and 3) a pair of opposed spaced flat plates having cams of common profile connected to accommodate a pair of followers on said transport carriage to control the relative position of the transport carriage during reciprocal motion thereof, the profile defined by said flat plate cams being such that a flat object transported by said transport carriage maintains a fixed gap and speed in passing said fixed position processing device.

2. A flat object transport system as in claim 1 wherein said transport carriage further comprises a retaining device for picking, holding and releasing flat objects.

3. A flat object transport system as in claim 2 wherein said retaining device includes a suction system.

4. A carton blank transport system as in claim 2 wherein said transport carriage further comprises a retaining device for picking, holding and releasing carton blanks.

5. A flat object transport system as in claim 1 wherein the profile said pair of spaced flat plate cams further defines a pickup position for said flat objects at a supply source and a release position for further processing.

6. A flat object transport system as in claim 5 wherein said supply source is a stack of said flat objects in a magazine.

7. A flat object transport system as in claim 6 wherein said transport carriage further comprises a retaining device, including a suction system, for picking, holding and releasing flat objects.

8. A flat object transport system as in claim 1 wherein said processing device comprises a glue applicator.

9. A flat object transport system as in claim 1 including devices to selectively adjust and retain the position of said processing device.

10. A carton blank transport system comprising:

(a) a fixed position glue applicator for applying glue to a carton blank from said fixed position during a glue applying operation of the glue applicator wherein the fixed position is selectively adjustable between operations to accommodate different flat objects but in which the carton blank moves and the glue applicator remains still during said glue applying operation;

(b) a carton blank transport carriage for carrying a carton blank to be processed past said fixed position glue applicator; and (c) a reciprocating transport mechanism having a position and velocity control system further comprising:

1) a rotary eccentric drive cam for driving said reciprocating transport mechanism;

2) a crank lever connected between said rotary eccentric drive cam and said transport carriage; and 3) a pair of opposed spaced flat plates having cams of common profile connected to accommodate a pair of followers on said transport carriage to control the relative position of the transport carriage during reciprocal motion thereof, the profile defined by said flat plate cams being such that a carton blank transported by said transport carriage maintains a fixed gap and speed in passing said fixed position glue applicator.

11. A carton blank transport system as in claim 4 wherein said retaining device includes a suction system.

12. A carton blank transport system as in claim 10 wherein the profile of said pair of spaced flat plate cams further defines a pickup position for said carton blanks at a supply source and a release position for further processing.

13. A carton blank transport system as in claim 12 wherein said supply source is a stack of said carton blanks in a magazine.

14. A carton blank transport system as in claim 13 wherein said transport carriage further comprises a retaining device for picking, holding and releasing carton blanks.

15. A carton blank transport system as in claim 14 wherein said retaining device includes a suction system.

16. A carton blank transport system as in claim 12 wherein said release position is in alignment with a carton forming head die.

17. A carton blank transport system as in claim 10 wherein said glue applicator includes a detector for detecting the edge of a carton blank and a programmable timer for timing application of glue to said carton blank.

18. A carton blank transport system as in claim 17 wherein said detector includes an optical detection device which activates said timer.

19. A carton blank transport system as in claim 17 wherein said glue applicator includes a plurality of spaced glue guns to apply glue to opposite spaced tabs of a carton blank.

20. A carton blank transport system as in claim 10 including devices to selectively adjust and retain the position of said glue applicator.

* * * * *